US008109315B2

(12) United States Patent
Schneider

(10) Patent No.: US 8,109,315 B2
(45) Date of Patent: Feb. 7, 2012

(54) ACCORDION PARTITION

(75) Inventor: Malte Schneider, Wenden-Doernscheid (DE)

(73) Assignee: Sunflex Aluminiumsysteme GmbH, Wenden-Gerlingen (DE)

( * ) Notice: Subject to any disclaimer, the term of this patent is extended or adjusted under 35 U.S.C. 154(b) by 80 days.

(21) Appl. No.: 12/834,714

(22) Filed: Jul. 12, 2010

(65) Prior Publication Data

US 2011/0005691 A1 Jan. 13, 2011

(30) Foreign Application Priority Data

Jul. 13, 2009 (DE) ..... 10 2009 033 148

(51) Int. Cl.
*E05D 15/26* (2006.01)

(52) U.S. Cl. ..... 160/199; 160/206; 292/156

(58) Field of Classification Search ..... 160/199, 160/196.1, 118, 206, 213, 183; 292/40, 41, 292/74, 156, 230
See application file for complete search history.

(56) References Cited

U.S. PATENT DOCUMENTS 1,191,223 A * 7/1916 Plice ..... 160/199
1,524,006 A * 1/1925 Dodge ..... 160/113
3,263,734 A * 8/1966 Lister ..... 160/113
3,329,990 A * 7/1967 Johnson, Jr. ..... 16/404
3,871,083 A * 3/1975 Smith ..... 16/383
3,907,021 A * 9/1975 Smith ..... 160/118
3,973,616 A * 8/1976 Jensen ..... 160/199
4,386,645 A * 6/1983 Dever et al. ..... 160/183
4,574,860 A * 3/1986 Weiss ..... 160/118
4,834,161 A * 5/1989 Johnson et al. ..... 160/84.08
5,477,903 A * 12/1995 Figueiredo et al. ..... 160/183

* cited by examiner

*Primary Examiner* — David Purol
(74) *Attorney, Agent, or Firm* — Andrew Wilford

(57) ABSTRACT

An accordion partition has a pair of panels having adjacent vertical inner and outer side edges interconnected by a hinge. Horizontal and generally parallel upper ceiling and lower floor tracks extend above and below the pair of panels, and upper and lower trolley hardware on each of the panels rides in the respective tracks so that the panels can move horizontally relative to one another. Respective latches on each of the outer edges can move between locked positions engaged in one of the tracks and an unlocked position clear of the one track. Coupling elements on both of the latches interengage only in the extended use position for shifting both of the latches synchronously between the respective locked and unlocked positions. An actuator on only one of the latches manually shifts the one latch between the locked and unlocked position.

11 Claims, 3 Drawing Sheets

ACCORDION PARTITION

FIELD OF THE INVENTION

The present invention relates to an accordion partition. More particularly this invention concerns such a partition usable as a room divider.

BACKGROUND OF THE INVENTION

A standard has at least one pair of panels that are pivoted on each other by hinges and that are mounted in a guide consisting of at least a floor and a ceiling track. The panels are horizontally displaceable in the tracks, and each panel consists of a frame having two essentially vertical sides with a filling. The frame of at least one panel of each pair of panels is engaged at one side with hardware such as trolleys in the floor and/or ceiling tracks, the other side of the one panel or the one side of the second panel of the pair connected with the first panel by the hinge being provided with a directly actuatable latch engageable at the bottom and/or at the top in the floor and/or ceiling track.

This type of accordion partition is known in various embodiments for various applications. For example, conservatories are provided with accordion partitions whose individual panels consist of a wood and/or an aluminum frame with an inserted glass pane as filling. A different embodiment allows for partitioning a large room into two smaller rooms. Here, for example, a wood or drywall panel is used as filling to make the panels opaque.

When securing accordion partitions of this type it has been shown that by means of the trolleys, only one leaf is in unilateral force-fit contact with the floor or ceiling track. For this reason it has already been proposed—either at the opposite side of the panel, or also at the second panel that is connected to the first panel by means of the hinges—to provide a latch that is operated by a handle. Using the handle, round rods are inserted into the floor and/or ceiling track. Force is transmitted from the leaf locked with the latch to the adjoining leaf takes place strictly through the hinge. As a result, especially in exterior areas, the safety standard was too low in this design.

OBJECTS OF THE INVENTION

It is therefore an object of the present invention to provide an improved accordion partition.

Another object is the provision of such an improved accordion partition that overcomes the above-given disadvantages, in particular that has a higher safety standard, that has a higher degree of safety against collapse, that can still be manufactured economically, and that is easy to operate.

SUMMARY OF THE INVENTION

An accordion partition has according to the invention a pair of panels each lying in a generally vertical plane and each having horizontally spaced inner and outer side edges. The panels are adjacent each other with the inner side edges of each panel closely juxtaposed with and parallel to each other. A hinge joins the inner side edges of the panels. Horizontal and generally parallel upper ceiling and lower floor tracks extend above and below the pair of panels, and upper and lower trolley hardware on each of the panels offset from the respective inner edges rides in the respective tracks so that the panels can move horizontally relative to one another between an extended use position lying generally coplanar with each other and with the tracks and a stowed position extending at an angle to each other and transversely of the tracks. Respective latches on each of the outer edges are each shiftable between a locked position engageable in one of the tracks and an unlocked position clear of the one track. Coupling elements on both of the latches interengage only in the extended use position for shifting both of the latches synchronously between the respective locked and unlocked positions only in the extended use position. An actuator on only one of the latches manually shifts the one latch between the locked and unlocked position so that in the stowed position movement of the one latch between the locked and unlocked positions has no effect on the latch of the other panel.

Thus way, a simple possibility is created of firmly locking both adjoining sides of adjacent panels in the floor and/or ceiling track, without requiring a transmission of force from the panel that is provided with the locking fitting to the adjoining panel by means of the hinges.

Furthermore according to attaining the object the latches each consist of a metal core whose upper and/or lower end is mounted in guide sleeves, and that the latches each have rectangular bolts at their ends that engage with the floor track and/or ceiling track at their ends guided in the tracks.

By selecting the rectangular cross section, significantly higher contact pressure per unit of surface area results between the floor and/or ceiling track on the one hand, and the bolt on the other hand, so that the safety factor against collapse is significantly increased.

It is an advantage that the coupling elements project out of the confronting faces of adjacent panels connected by hinges. As a result, when the accordion partition is closed, the shortest path for a transmission of force is ensured by means of the coupling elements. Hence, the shortest lever arms result, which thus also bring about the smallest bending loads on the latches, so that easy, problem-free locking is possible.

It is an advantage that the coupling elements, on lateral displacement of the panels can be brought into or out of the operative interengaged position. An interlocking of the coupling elements is only necessary when the accordion partition is closed. Only here can the latches engage with the floor and/or ceiling track, so that it must basically only be ensured that in this position the coupling elements are operative.

It has been shown to be successful that at least one of the coupling elements has a U-shape and is able to embrace the other coupling element between its U-arms. As a result of the U-shape, the opening as well as the closing motion can be transmitted to the second coupling element. Of course, it is also possible to provide several coupling elements adjacent each other in order to optimally transmit the force.

It is recommended that the actuators be provided with angled formations that are aligned with one another, when moving into the operative position of the coupling elements, so as to be in a position to compensate out coupling-member tolerances, for example, height tolerances. As a result of the angled formations the coupling elements safely engage into each other even at larger tolerances, and can thus be brought into the operative position. Upon rotating the coupling elements further into each other, the height tolerances are compensated by means of the angled formations.

According to the invention the guide sleeves can be installed into the frames and can be retained by means of snap catches. As a result, an economical design is achieved. When the guide elements wear out, these can easily be replaced again by new ones, as a result of which not only economical production, but also economical repair opportunity results.

It is advantageous that the latches with the bolts are detachably mounted. Here too, as a result of these steps, costs will be saved in the event of a potential repair.

Also noteworthy is a subassembly comprised of the coupling elements with the respective guide bushing and the rectangular bolt. This results in optimal security characteristics and an economical design.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
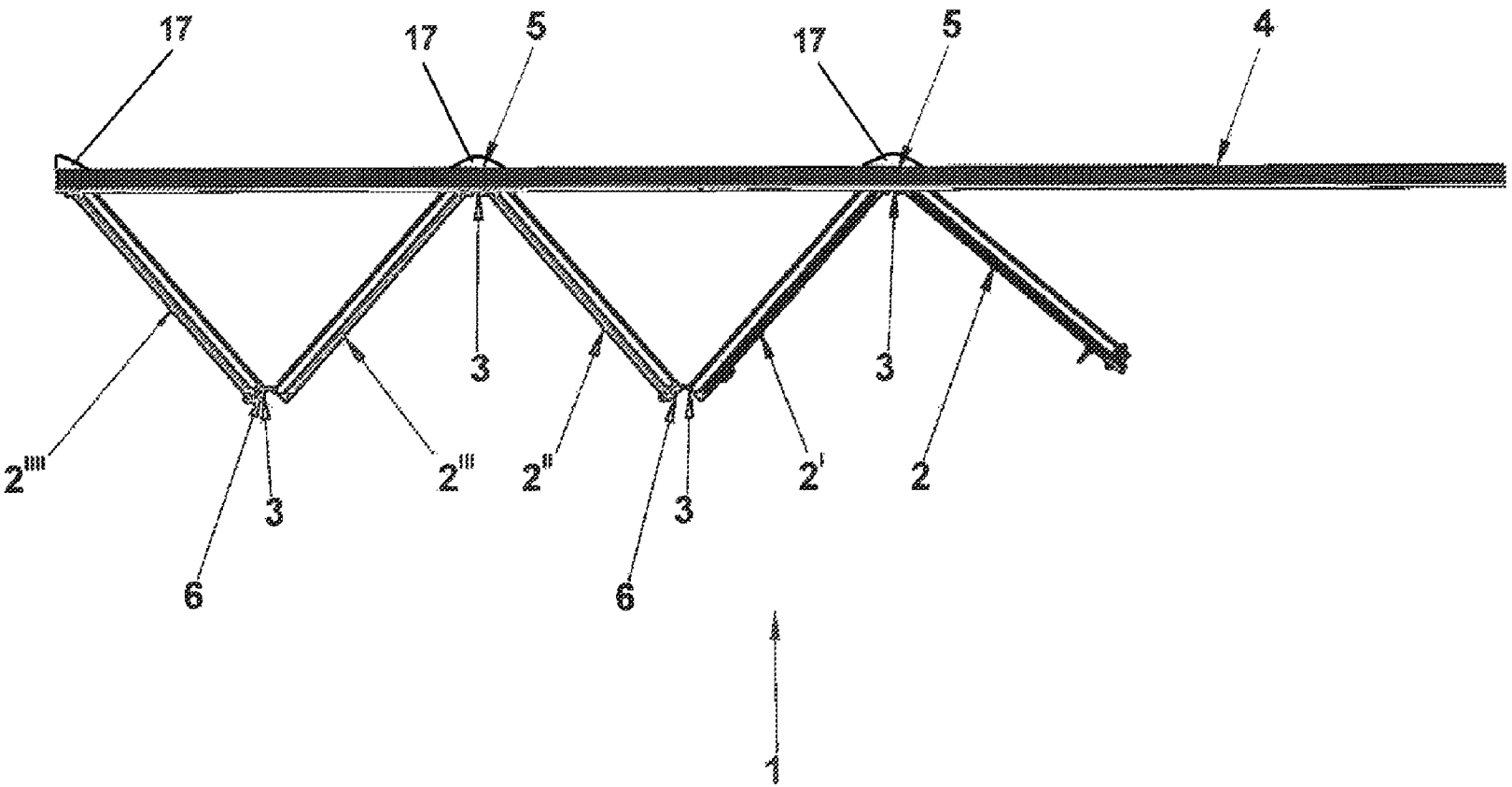
FIG. 1 is a schematic view of an accordion partition.

As seen in FIG. 1, an accordion partition 1 is shown that has two pairs panels 2, 2' and 2'', 2''' that are connected to each other by means of three hinges 3. The panels 2-2''' are guided in floor and ceiling tracks 4 by trolleys shown schematically at 17 at outer joints 5 that guide the panels 2 in the floor and ceiling tracks 4.

Latches 7 and 7' at inner joints 6 in accordance with the invention ensure a firm locking into the floor and ceiling tracks 4 when the accordion partition is closed with the panels 2-2''' coplanar.

Figure 2:
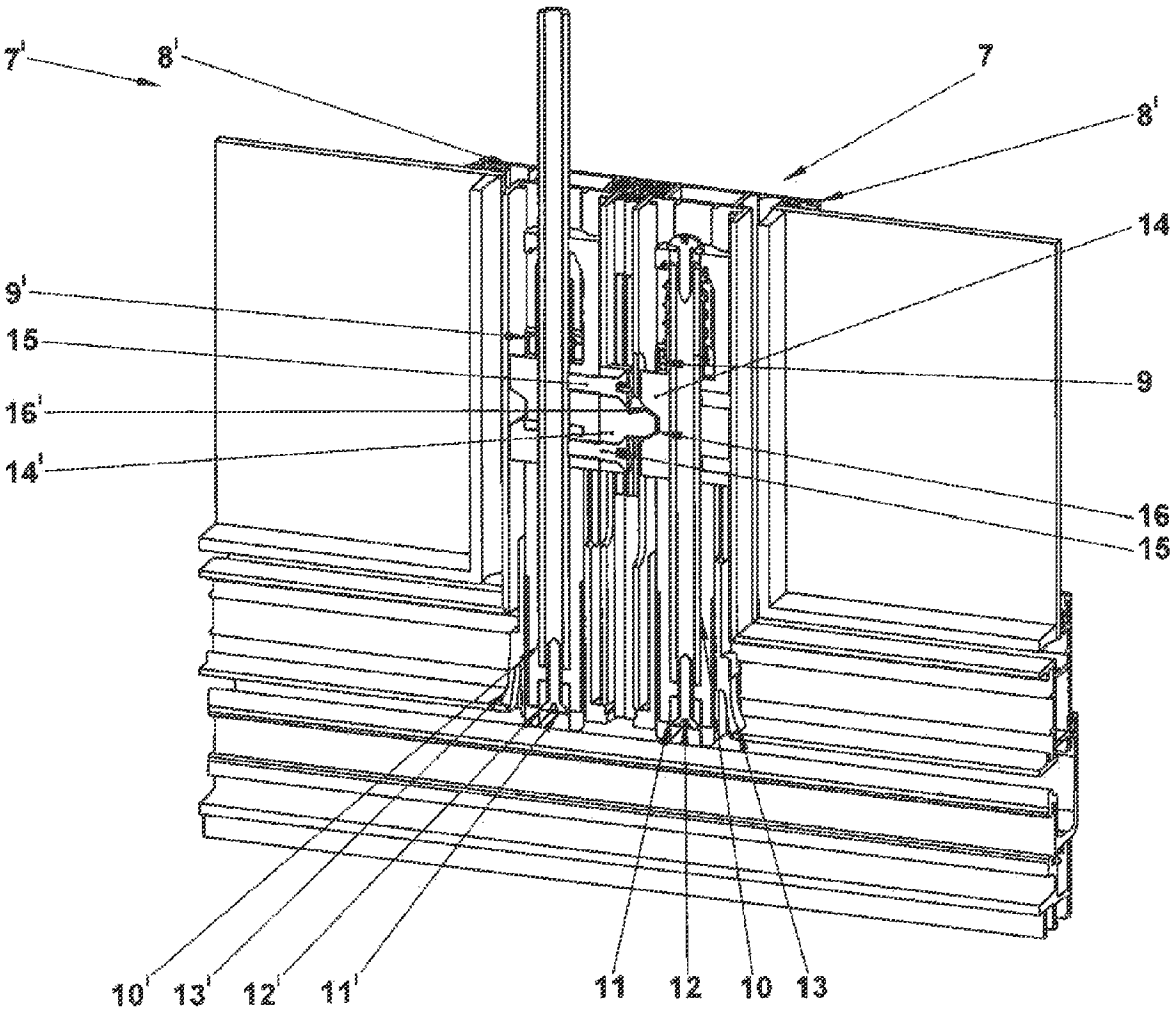
FIG. 2 is a sectional detail section view of two adjacent panels.

FIG. 2 shows two adjacent inner side edges 8, 8' in which the respective latches 7, 7' are held in respective guide sleeves 9, 9'. The latches 7, 7' consist of metal cores 10, 10' that can be operated by actuating means formed by a handle illustrated schematically at 18 in FIG. 3 in the latch 7. At the lower ends of the metal cores 10, 10', the guide sleeves 9, 9' hold slidable rectangular bolts 11, 11' that are connected by screws 12, 12' with the metal cores 10, 10'. The guide sleeves 9, 9' are slid into the inner side edges 8, 8' and retained in the inner side edges 8, 8' by catches 13, 13', and are thus detachable from the respective inner side edges 8, 8'.

The guide sleeves 9, 9' have lateral openings through which extend coupling elements 14, 14' here connected, for example, by screws 15, 15' with the metal cores 10, 10'. Structure between the cores 10, 10' and the respective sleeves 9, 9' ensures that the cores 10, 10' hold in both the inner retracted or unlocked position and in the outer projecting or locked position.

The coupling elements 14, 14' have angled formations or faces 16, 16', so that on closing the accordion partition 1, the coupling elements rotate into each other and in the case of height difference, compensate.

On actuation of the latch 7 by the handle 18, the end of the respective metal core 10 and thus the respective coupling element 14 is moved upward or downward. This way, when the accordion partition is closed and the coupling elements 14, 14' are engaged with each other, the coupling element 14' is entrained. The actuator 14' moves the metal core 10' upward or downward so that the latch 11' that is connected with the metal core 10' also moves in the floor or ceiling track 4.

Figure 3:
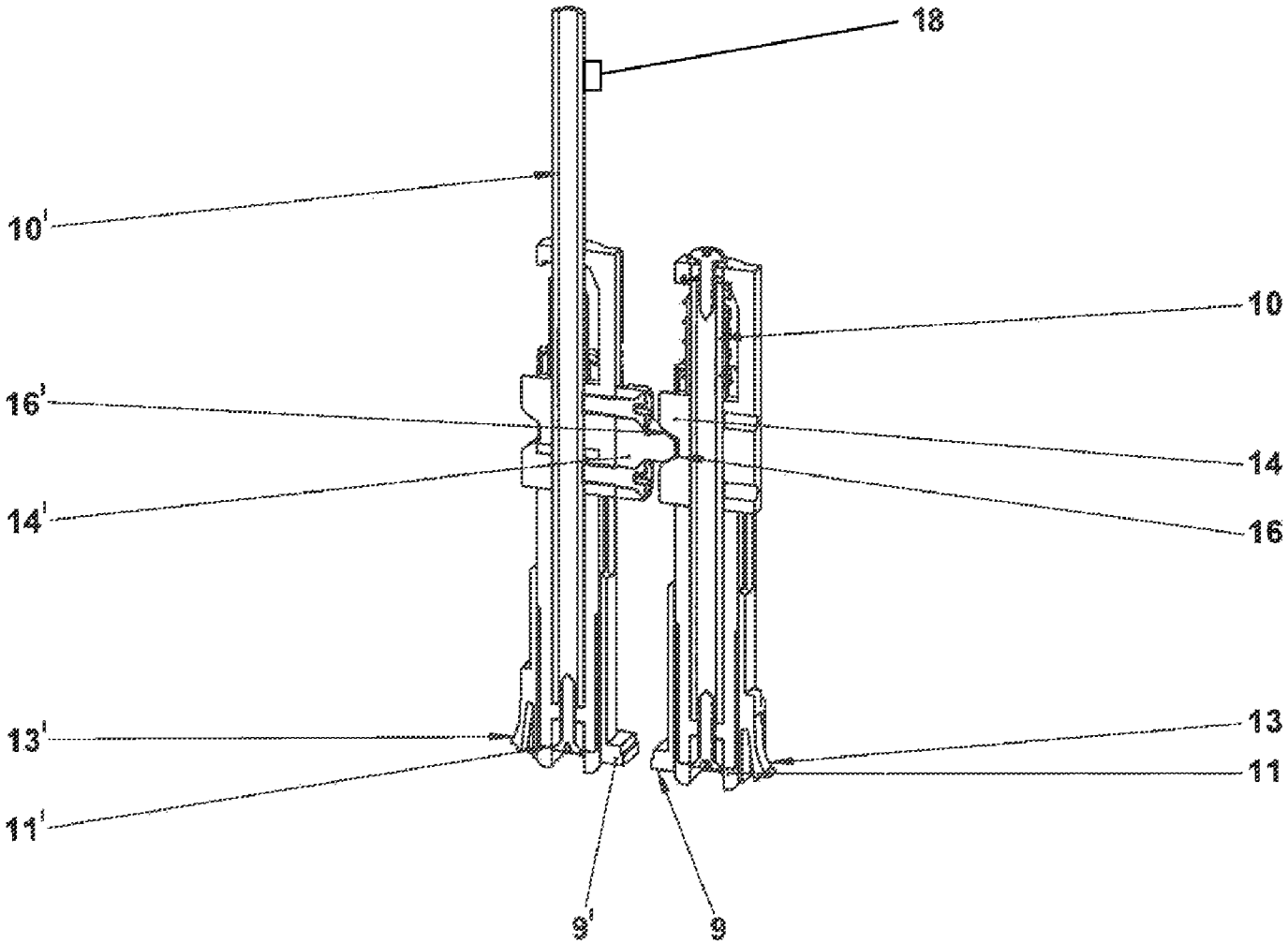
FIG. 3 is a view of a detail of FIG. 2.

FIG. 3 shows the important elements in accordance with the invention of the accordion partition 1. Here, the metal cores 10, 10', the guide sleeve 9', as well as the bolts 11, 11' can be seen. Further, the coupling elements 14, 14' are clearly shown, as well as the angled formations 16, 16'.

Because the adjacent frame sections 8, 8' are anchored in the floor track and ceiling track 4 by the bolts 11, 11', the degree of protection against collapse of the accordion door is significantly increased. The simple snapping in of the guide sleeve 9 not only makes the production of the accordion partition 1 more economical, but it also makes potential repair work resulting from wear more economical. The square bolts 11 ensure considerable surface engagement of the bolts 11, 11' in the floor or ceiling track 4, so that as a result of the increased contact pressure per unit of area, an additional, even better protection against collapse results.

I claim:

1. An accordion partition comprising:

a pair of panels each lying in a generally vertical plane and each having horizontally spaced inner and outer side edges, the panels being adjacent each other with the inner side edges of each panel closely juxtaposed with and parallel to each other;

a hinge joining the inner side edges of the panels;

horizontal and generally parallel upper ceiling and lower floor tracks above and below the pair of panels;

upper and lower trolley hardware on each of the panels offset from the respective inner edges and riding in the respective tracks, whereby the panels can move horizontally relative to one another between an extended use position lying generally coplanar with each other and with the tracks and a stowed position extending at an angle to each other and transversely of the tracks;

respective latches on each of the outer edges shiftable between a locked position engageable in one of the tracks and an unlocked position clear of the one track;

coupling elements on both of the latches interengageable only in the extended use position for shifting both of the latches synchronously between the respective locked and unlocked positions only in the extended use position; and means on only one of the latches for manually shifting the one latch between the locked and unlocked position, whereby in the stowed position movement of the one latch manually between the locked and unlocked positions has no effect on the other latch.

2. The accordion partition defined in claim 1 wherein the coupling elements project from faces of the edges of the inner sides of the panels.

3. The accordion partition defined in claim 2 wherein one of the elements is male and the other of the elements is female.

4. The accordion partition defined in claim 3 wherein the elements have interengageable angled faces that extend at a small acute angle to the horizontal and that engage each other on movement of the panels from the stowed position to the extended position, whereby minor vertical misalignment of the elements is compensated for by the angled faces.

5. The accordion partition defined in claim 3 wherein one of the elements is U-shaped and has a pair of arms and the other of the elements is engageable between the arms.

6. The accordion partition defined in claim 1 wherein each of the latches includes:

a tubular guide secured in the respective edge;

a metal core vertically shiftable in the respective edge; and a bolt at an outer end of the core engageable in the ceiling or floor track.

7. The accordion partition defined in claim 6 wherein the bolts are of square section and have flat faces engageable flatly with the ceiling or floor track.

8. The accordion partition defined in claim 6 wherein each of the bolts is releasably secured to the respective core.

9. The accordion partition defined in claim 6 wherein each latch is provided with a catch releasably securing the respective guide tube in the respective side edge.

10. The accordion partition defined in claim 1 wherein there are a plurality of the pairs of the panels with the outer edges of adjacent pairs also interconnected by such hinges, the trolley hardware being at the outer side edges.

11. An accordion partition comprising:

a plurality of pairs of panels each lying in a generally vertical plane and each having horizontally spaced and vertical inner and outer side edges, the panels being adjacent each other in a row with the inner side edges of each panel of each pair closely juxtaposed with and parallel to each other and the outer edges of the panels of at least one of the pairs being closely juxtaposed with the outer edges of panels of others of the pairs;

inner hinges joining the inner side edges of the panels of each pair;

outer hinges joining the outer edges of each of the panels of at least some of the pairs to outer edges of the panels of others of the pairs;

horizontal and generally parallel upper ceiling and lower floor tracks above and below the pairs of panels;

upper and lower trolley hardware on each of the panels offset from the respective inner edges and riding in the respective tracks, whereby the panels can move horizontally relative to one another between an extended use position lying generally coplanar with each other and with the tracks and a stowed position extending at an angle to each other and transversely of the tracks;

respective latches on each of the outer edges shiftable between a locked position engageable in one of the tracks and an unlocked position clear of the one track;

coupling elements on both of the latches of each of the adjacent pairs of outer edges interengageable only in the extended use position for shifting both of the latches of each of the adjacent pairs of outer edges synchronously between the respective locked and unlocked positions only in the extended use position; and means on only one of the latches of each pair of adjacent outer edges for manually shifting the one latches of each of the pairs of adjacent outer edges between the locked and unlocked position, whereby in the stowed position movement of the one latches manually between the locked and unlocked positions has no effect on the other latches.

* * * * *